US007171818B2

(12) United States Patent
Oh et al.

(10) Patent No.: US 7,171,818 B2
(45) Date of Patent: Feb. 6, 2007

(54) SYSTEM AND METHOD FOR CONTROLLING TEMPERATURE OF REFRIGERANT IN AIR CONDITIONER

(75) Inventors: Il Kwon Oh, Seoul (KR); Jin Seob Song, Goonpo-si (KR); Nam Soo Lee, Seoul (KR); Se Dong Chang, Gwangmyeong-si (KR); Baik Young Chung, Incheon-si (KR)

(73) Assignee: LG Electronics Inc., Seoul (KR)

( * ) Notice: Subject to any disclaimer, the term of this patent is extended or adjusted under 35 U.S.C. 154(b) by 169 days.

(21) Appl. No.: 10/958,123

(22) Filed: Oct. 5, 2004

(65) Prior Publication Data

US 2005/0081543 A1 Apr. 21, 2005

(30) Foreign Application Priority Data

Oct. 16, 2003 (KR) ..... 10-2003-0072182

(51) Int. Cl.
*F25B 41/00* (2006.01)
*F25B 41/04* (2006.01)
*F25B 49/00* (2006.01)

(52) U.S. Cl. ..... 62/113; 62/197; 62/198; 62/225; 62/513

(58) Field of Classification Search ..... 62/113, 62/197, 198, 225, 513
See application file for complete search history.

(56) References Cited

U.S. PATENT DOCUMENTS 5,626,026 A * 5/1997 Sumida et al. ..... 62/129
6,581,397 B1 * 6/2003 Taira et al. ..... 62/199
6,935,128 B2 * 8/2005 Ito et al. ..... 62/222
2004/0244411 A1 * 12/2004 Ichimura et al. ..... 62/513
2005/0081539 A1 4/2005 Hawang et al.
2006/0048539 A1 * 3/2006 Takechi et al. ..... 62/513

FOREIGN PATENT DOCUMENTS

KR 1997-011612 6/1998
KR 2002-0071223 9/2002

* cited by examiner

*Primary Examiner*—Marc Norman
(74) *Attorney, Agent, or Firm*—Greenblum & Bernstein, P.L.C.

(57) ABSTRACT

There is provided a system and method for controlling a temperature of a refrigerant in an air conditioner, in which a supercooling degree and/or a superheating degree can be secured by controlling a difference in refrigerant temperatures of a pipe connecting one or more indoor units to one or more outdoor units, and a flow of a specific refrigerant. The system includes: one or more indoor units; one or more outdoor units; a high-pressure pipe and a low-pressure pipe for connecting the indoor units and the outdoor units; and a refrigerant temperature control unit coupled to the high-pressure pipe and the low-pressure pipe, for performing a heat exchange with respect to flowing refrigerants by coupling an inner pipe to an outer pipe, the inner pipe passing through the another pipe. The refrigerant temperature control unit is installed in one side of the high-pressure or low-pressure pipe and senses a supercooling degree and/or a superheating degree and increasing/decreasing a refrigerant inlet flow to the outer pipe through a bypass passage, which couples the outer pipe to a specific pipe, so as to make the sensed supercooling or superheating degree equal to a target value.

24 Claims, 10 Drawing Sheets

SYSTEM AND METHOD FOR CONTROLLING TEMPERATURE OF REFRIGERANT IN AIR CONDITIONER

BACKGROUND OF THE INVENTION

1. Field of the Invention

The present invention relates to an air conditioner, and more particularly, to a system and method for controlling a temperature of a refrigerant in an air conditioner, in which a supper-heating degree and/or a supper-cooling degree can be secured by controlling an amount of refrigerant which is heat exchanged due to a difference in temperature of refrigerant at a predetermined position of a pipe connecting an indoor unit and an outdoor unit.

2. Description of the Related Art

An air conditioner is an apparatus that can control air temperature, humidity, stream and cleanliness so as to make comfortable circumference. Recently, a multi-type air conditioner has been developed. The multi-type air conditioner includes a plurality of indoor units installed in partitioned spaces and controls air temperatures of the respective spaces.

A heat pump system can be used both as a cooling system and a heating system in accordance with a refrigeration cycle and a heating cycle. The refrigeration cycle makes a refrigerant flow through a normal passage and the heating cycle makes a refrigerant flow through a reverse passage.

FIG. 1 illustrates a relationship of a general refrigeration cycle and a Molier diagram. As shown in FIG. 1, the refrigeration cycle is performed by iterative operations of refrigerant compression, condensation, expansion and vaporization.

A compressor 10 compresses an introduced refrigerant and discharges a high-temperature and high-pressure heated vapor to an indoor heat exchanger 15. At this point, a state of the refrigerant discharged from the compressor 10 becomes a superheating degree (SH), which exceeds a saturated state on the Molier diagram.

An outdoor heat exchanger 15 performs a heat exchange between the discharged high-temperature and high-pressure refrigerant with an outdoor air, resulting in a phase change into a liquid state. At this point, heat of the refrigerant is removed by air passing through the outdoor heat exchanger 15, such that its temperature is rapidly lowered. As a result, the refrigerant is transferred in a liquid state of a supercooling degree (SC).

An expander 20 decompresses the suppercooled refrigerant, making it easy to evaporate the refrigerant at the indoor heat exchanger 25.

The indoor heat exchanger 25 performs a heat exchange between the decompressed refrigerant with the outdoor air. At this point, heat of the refrigerant is removed by air passing through the indoor heat exchanger, such that its temperature increases. As a result, phase of the refrigerant is changed into a liquid state.

The refrigerant introduced from the indoor heat exchanger 25 to the compressor 10 becomes a gaseous state of a superheating degree $T_{SH}$, in which it is evaporated over the saturated state.

In the relationship between the refrigeration cycle and the Molier diagram, the refrigerant passes through the compressor 10, the outdoor heat exchanger 15, the expander 20, and the indoor heat exchanger 25. The refrigerant discharged from the indoor heat exchanger 25 is again introduced into the compressor 10.

While the refrigerant is transferred from the indoor heat exchanger 25 to the compressor 10, the phase of the refrigerant is changed into the superheating degree. That is, the refrigerant introduced into or discharged from the compressor 10 must be a complete liquid state.

However, it is a theoretical result and a predetermined error occurs in an actual application to the products. Also, when an amount of refrigerant flowing during the refrigeration cycle is relatively small or large compared with the heat exchange state, the phase change does not occur completely in the respective processes.

Due to these problems, the refrigerant introduced from the indoor heat exchanger 25 to the compressor 10 is not changed into a complete superheated vapor and it often exists in a liquid state. When the refrigerant of a liquid state is accumulated in an accumulator (not shown) and introduced into the compressor 10, a noise occurs increasingly and performance of the compressor is degraded.

Also, when the heat pump system changes from the heating mode to the defrosting mode or from the defrosting mode to the heating mode, a probability that the refrigerant of a liquid state will be introduced into the compressor 10 is very high. The reason for this is that the refrigerant flow is changed while the heat exchanger acting as the indoor heat exchanger operates as a condenser during the mode switching process and, on the contrary, the heat exchanger acting as the outdoor heat exchanger operates as an evaporator.

The refrigerant introduced into the compressor 10 is made to have the superheating degree ($T_{SH}$) by controlling a flow rate of the refrigerant using the expander 20, thereby preventing a phenomenon that the refrigerant of a liquid state is excessively accumulated in the accumulator and then introduced into the compressor. Here, the expander 20 includes a linear electronic expansion valve (LEV) or an electronic expansion valve (EEV). This valve will be referred to as an EEV.

The multi-type air conditioner includes at least one outdoor unit and a plurality of indoor units connected to the outdoor unit, and it operates in a heating mode and a cooling mode. Such a multi-type air conditioner tends to be developed to selectively operate in a heating or cooling mode with respect to the individual rooms.

The related art air conditioner has following problems.

As a supercooling degree for the inlet flow of the indoor unit is degraded according to installation conditions of short/medium/long pipes and height differences, a refrigerant flow noise occurs severely due to the expander included in the indoor unit.

In the related art air conditioner, a current state of the refrigerant is measured using a sensor or the like, which is installed in the inlet and outlet pipes of the outdoor heat exchanger or the compressor. Then, a supercooling degree and a superheating degree are calculated and controlled using the current state of the refrigerant. In this case, however, there occurs a problem in that the supercooling degree cannot be secured due to a pressure loss under the installation conditions of the long pipe and height difference.

Also, the supercooling degree may be degraded because the multi-type air conditioner has a bad branching characteristic or a length of the pipe after a branched pipe is long.

Further, when a refrigerant noise claim occurs in the multi-type air conditioner, an algorithm for the outdoor unit or a structural design must be modified.

Like this, it may be difficult to secure the supercooling degree due to the pressure loss or heat loss, which occurs under the installation conditions of the long pipe and height difference. In this case, a refrigerant noise may occur very seriously.

SUMMARY OF THE INVENTION

Accordingly, the present invention is directed to an air conditioner that substantially obviates one or more problems due to limitations and disadvantages of the related art.

A first object of the present invention is to provide a system and method for controlling a temperature of a refrigerant in a multi-type air conditioner, in which a supercooling degree and/or a superheating degree can be secured. The system includes a refrigerant temperature control unit between a high-pressure pipe and a low-pressure pipe. One pipe passes through another pipe and the supercooling degree and/or the superheating degree is secured using a temperature difference of a flowing refrigerant and controlling an amount of a refrigerant through a bypass passage.

A second object of the present invention is to provide a system and method for controlling a temperature of a refrigerant, which can secure a supercooling degree using a temperature difference of refrigerants flowing through a high-pressure pipe and a low-pressure pipe under a control of a supercooling degree control unit installed in a predetermined position of the high-pressure and low-pressure pipes.

A third object of the present invention is to provide a system and method for controlling a temperature of a refrigerant, in which a superheating degree can be secured using a temperature of refrigerants flowing through a high-pressure pipe and a low-pressure pipe under a control of a superheating control unit installed in a predetermined position of the high-pressure and low-pressure pipes.

A fourth object of the present invention is to provide a system and method for controlling a temperature of a refrigerant in an air conditioner, in which a supercooling degree and a superheating degree can be simultaneously secured using a supercooling/superheating degree control unit installed at a predetermined position of high-pressure and low-pressure pipes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a system for controlling a temperature of refrigerant in an air conditioner includes: one or more indoor units; one or more outdoor units; a high-pressure pipe and a low-pressure pipe for connecting the indoor units and the outdoor units; and a refrigerant temperature control unit coupled to the high-pressure pipe and the low-pressure pipe, for performing a heat exchange with respect to flowing refrigerants by coupling an inner pipe to an outer pipe, the inner pipe passing through the another pipe, the refrigerant temperature control unit installed in one side of the high-pressure or low-pressure pipe, for sensing a supercooling degree and/or a superheating degree and increasing/decreasing a refrigerant inlet flow to the outer pipe through a bypass passage, which couples the outer pipe to a specific pipe, so as to make the sensed supercooling or superheating degree equal to a target value.

Preferably, the refrigerant temperature control unit may be one of a supercooling degree control unit, a superheating degree control unit and a supercooling/superheating degree control unit.

According to another embodiment of the present invention, a method for controlling a temperature of a refrigerant includes the steps of: performing a heat exchange due to a difference of a temperature between a high-pressure refrigerant and a low-pressure refrigerant using a heat exchanging part, the heat exchanging part including an inner pipe and an outer pipe whose both ends are coupled to high-pressure and low-pressure pipes connecting at least one indoor unit and at least one outdoor unit; sensing a supercooling degree and/or a superheating degree at pipes disposed at one side of the heat exchanging part; and securing a supercooling degree and/or a superheating degree by increasing/decreasing a predetermined amount of a refrigerant flowing into an outer pipe of the heat exchanging part such that the sensed supercooling degree and/or superheating degree are/is made to be equal to a target value.

According to the present invention, the refrigerant temperature control unit is installed between the high-pressure pipe and the low-pressure pipe and controls a temperature difference and amount of a refrigerant flowing through two pipes, thereby securing a supercooling degree or a superheating degree or a supercooling/superheating degree. Accordingly, it is possible to secure the supercooling degree and/or the superheating degree regardless of operation cycle characteristics.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

It is preferable that an air conditioner according to the present invention includes one or more outdoor units and one or more indoor units. The present invention can be applied to a cooling/heating switching type product and a multi-type air conditioner which can operate in a cooling mode, a heating mode, a cooling-based concurrent cooling/heating mode, and a heating-based concurrent cooling/heating mode.

Figure 1:
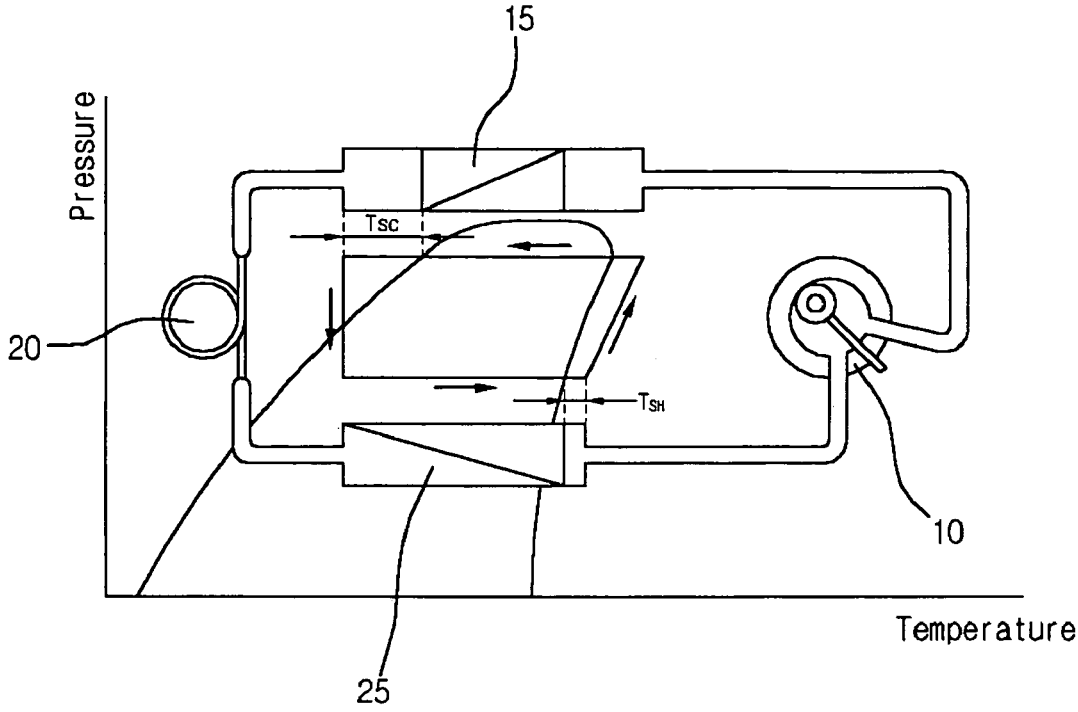
FIG. 1 is a view illustrating an operation cycle of a related art air conditioner.
Figure 2:
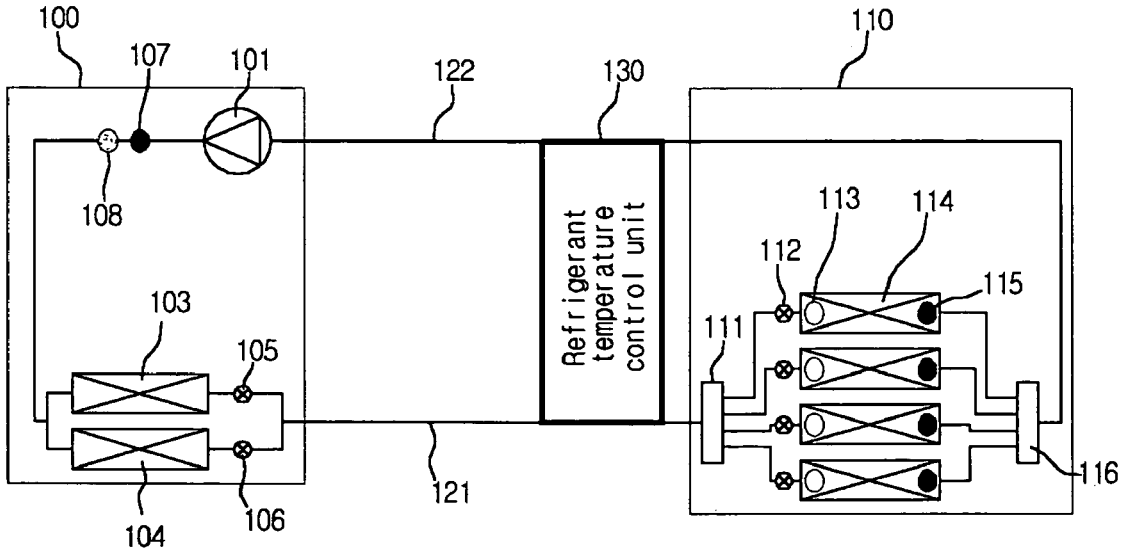
FIG. 2 is a view illustrating a system for controlling a temperature of a refrigerant in an air conditioner according to an embodiment of the present invention.

FIG. 2 is a schematic view of an air conditioner according to the present invention.

Referring to FIG. 2, an air conditioner includes one or more outdoor units 100 and one or more indoor units 110. The units 100 and 110 are coupled through pipes 121 and 122. A refrigerant temperature control unit 130 for controlling a temperature of a refrigerant is installed between the pipes so as to secure a supercooling degree and/or a superheating degree of the pipe 121 and 122.

The outdoor unit 100 includes a compressor 101, one or more outdoor heat exchangers 103 and 104, and EEVs 105 and 106 installed in inlet sides of the outdoor heat exchangers 103 and 104.

The indoor unit 110 is installed in each partitioned room and includes one or more indoor EEVs 112 and one or more indoor heat exchangers 114. Headers 111 and 116 are installed on both sides of the indoor heat exchanger.

Such an air conditioner constructs a closed circuit by sequentially connecting the compressor 101, the outdoor heat exchangers 103 and 104, the outdoor EEVs 105 and 106, the indoor EEV 112, and the indoor heat exchanger 114 through refrigerant pipes.

A refrigerant pipe for connecting an outlet side of the compressor 101 to an inlet side of the indoor EEV 112 is a high-pressure pipe 121 that guides a flow of a high-pressure refrigerant discharged from the compressor 101, and a refrigerant pipe for connecting an outlet side of the indoor EEV 112 to an inlet side of the compressor 101 is a low-pressure pipe 122 that guides a flow of a low-pressure refrigerant expanded at the indoor EEV 112. Accordingly, the outdoor heat exchangers 103 and 104 are installed on passage of the high-pressure pipe 121, and the indoor heat exchangers are installed on passage of the low-pressure pipe 122.

If the compressor 101 is driven, the discharged refrigerant is switched depending on a cooling mode or a heating mode by a passage switching valve (not shown) and it flows in an opposite direction.

Here, the supercooling degree is controlled using a high-pressure sensor 107 and a temperature senor 108, which are disposed at the outlet side of the compressor 101. Also, the superheating degree is controlled using temperature sensors 113 and 115, which are disposed at the inlet and outlet sides of the indoor heat exchanger 114.

Regarding the relationship between the refrigeration cycle and Molier diagram based on the above-described operation cycle, the refrigerant transferred from the compressor 101 through the outdoor heat exchangers 103 and 104 to the indoor heat exchanger 114 must secure the supercooling degree. On the contrary, the refrigerant transferred from the indoor heat exchanger 114 to the compressor 101 must secure the superheating degree. Also, the refrigerant introduced into the compressor 101 or discharged thereto must be a complete liquid state.

For this purpose, the refrigerant temperature control unit 130 for securing the supercooling degree and/or the superheating degree is installed at predetermined positions of the high-pressure and low-pressure pipes 121 and 122 that connect the outdoor unit 100 to the indoor unit 110.

The refrigerant temperature control unit 130 can be installed closer to the indoor unit 110, that is, adjacent to the indoor EEV 112 and the indoor heat exchanger 114. Also, when the refrigerant temperature control unit 130 is installed in front ends of the headers 111 and 115 and bridges, the supercooling degree can also be secured.

Also, the refrigerant temperature control unit 130 can be provided with a single unit such that it independently controls a refrigerant temperature without communication with the indoor and outdoor units. In this case, it is preferable to supply a separate voltage to a board. Further, in the presence of an existing communication line, the refrigerant temperature control unit 130 can transmit and receive refrigerant states (temperature, pressure) so as to communicate with other units.

Figure 3:
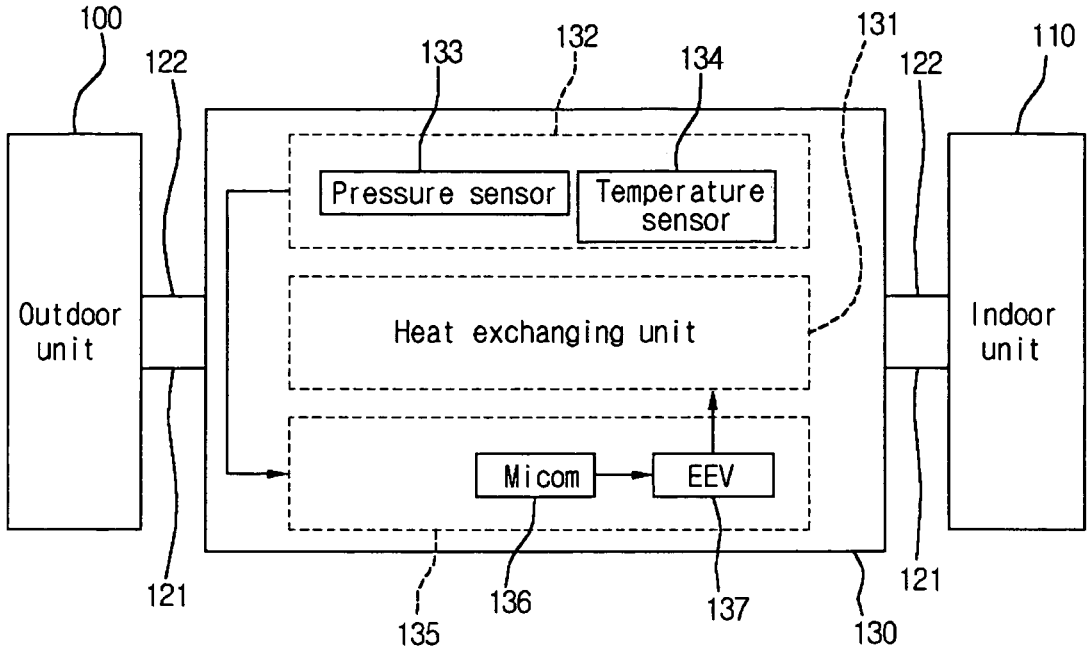
FIG. 3 is a block diagram of the system according to an embodiment of the present invention.

FIG. 3 is a view of the refrigerant temperature control unit 130.

Referring to FIG. 3, the refrigerant temperature control unit 130 includes a heat exchanging part 131, a refrigerant temperature sensing part 132, and a refrigerant temperature control unit 135. The heat exchanging part 131 is connected to the high-pressure and low-pressure pipes 121 and 122 and performs a heat exchange due to a difference of a refrigerant temperature. The refrigerant temperature sensing part 132 is installed on one side of the pipe and senses a supercooling. The refrigerant temperature control unit 135 controls a heat exchanged amount of the heat exchanging part 131 according to the sensing result of the refrigerant temperature sensing part 132.

Here, the heat exchanging part 131 is installed in a dual pipe type such that the heat can be exchanged using a difference of temperature between a room-temperature and high-pressure refrigerant of the high-pressure pipe 121 and a low-temperature and low-pressure refrigerant of the low-pressure pipe 122. In the dual pipe, an inner pipe may be coupled to the high-pressure pipe and an outer pipe may be extended to an outside of the inner pipe and coupled to the low-pressure pipe.

That is, the dual pipe of the heat exchanging part 131 is installed between portions which are cut away between the high-pressure and low-pressure pipes. In order for the heat exchange efficiency, the inner pipe is coupled in a predetermined shape (for example, a "ㄹ" shape) and the outer pipe is formed in a cylindrical shape and installed extending larger than an outer radius of the inner pipe. As another example, it is preferable that the inner and outer pipes of the dual pipe are formed in a shape such that the heat exchange efficiency between the refrigerants can increase. Also, a heat-sinking fin can be formed in an outside of the inner pipe or an inside of the outer pipe.

The refrigerant temperature sensing part 132 includes one or more sensors that can sense the supercooling degree and/or the superheating degree at the pipes. That is, the refrigerant temperature sensing part 132 includes one or more temperature sensors 134 for sensing an outflow temperature of the pipe disposed at one side of the heat exchanging part 131, and one or more temperature sensors or pressure sensors 133 for detecting a saturation temperature or a pressure of the high-pressure pipe. The pressure sensor 133 may be installed in the inlet side or the outlet side of the high-pressure pipe so as to measure a high-pressure and saturation temperature.

Here, the refrigerant temperature sensing unit 132 can operate as a supercooling degree sensing part and/or a superheating degree sensing part.

The refrigerant temperature control unit 135 includes a microcomputer (Micom) 136 and an EEV 137. The microcomputer 136 calculates deviations in the supercooling/superheating degrees and target supercooling/superheating degrees according to the sensing result of the refrigerant temperature sensing unit 132. Then, an opening degree of the EEV 137 is controlled to decrease the calculated deviation. In this manner, the heat exchanged amount of the heat exchanging part 131 is controlled.

Here, the refrigerant temperature control unit 135 can operate as a supercooling degree control unit and/or a superheating degree control unit.

The refrigerant temperature control unit 130 controls a supercooling degree $T_{SC}$ with respect to the refrigerant transferred to the indoor unit 110 and controls a superheating degree $T_{SH}$ with respect to the refrigerant transferred to the outdoor unit 100. That is, an amount of a flowing refrigerant is controlled using a bypass, a branch and so on, so that at least one refrigerant can supercool or superheat other refrigerants by controlling differences in pressure and temperature of two pipes and the heat exchanged amount of the refrigerant.

When the refrigerant temperature control unit 130 operates as the supercooling degree control unit, the superheating degree control unit or the supercooling/superheating degree control unit, the respective embodiments of the refrigerant temperature control unit 10 will now be described.

First Embodiment

Figure 4:
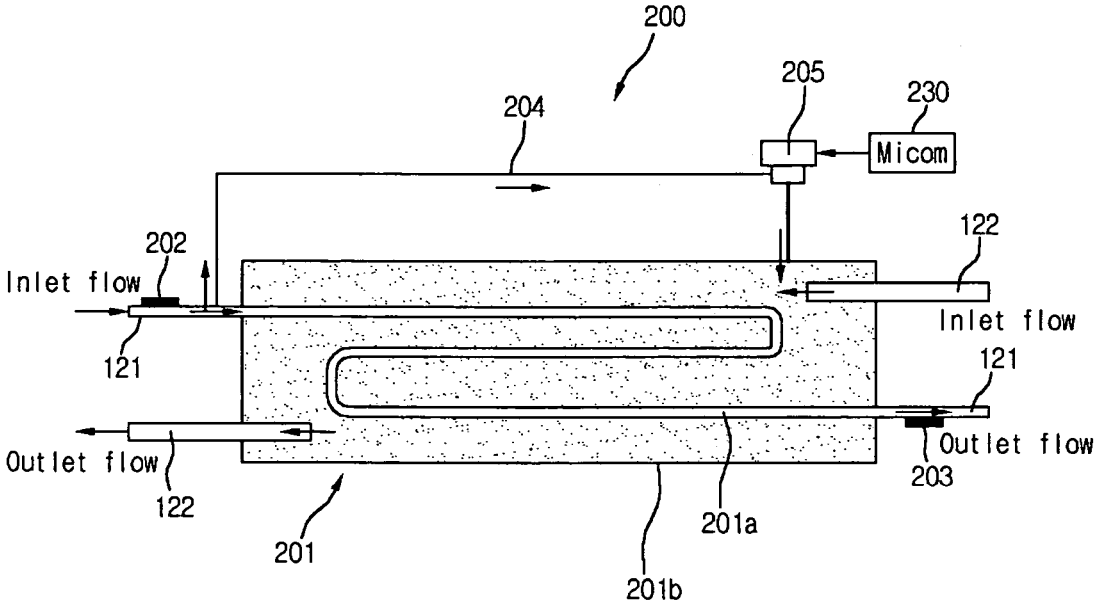
FIG. 4 is a view illustrating a construction of a supercooling degree control unit according to a first embodiment of the present invention.
Figure 5:
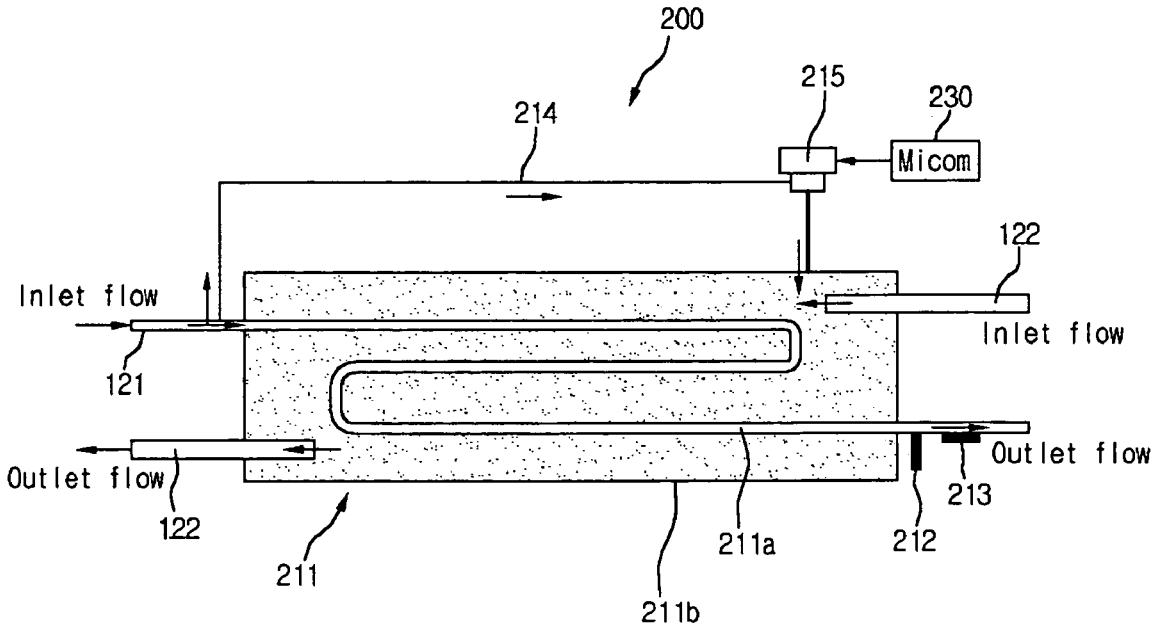
FIG. 5 is a view illustrating another construction of the supercooling degree control unit according to the first embodiment of the present invention.
Figure 6:
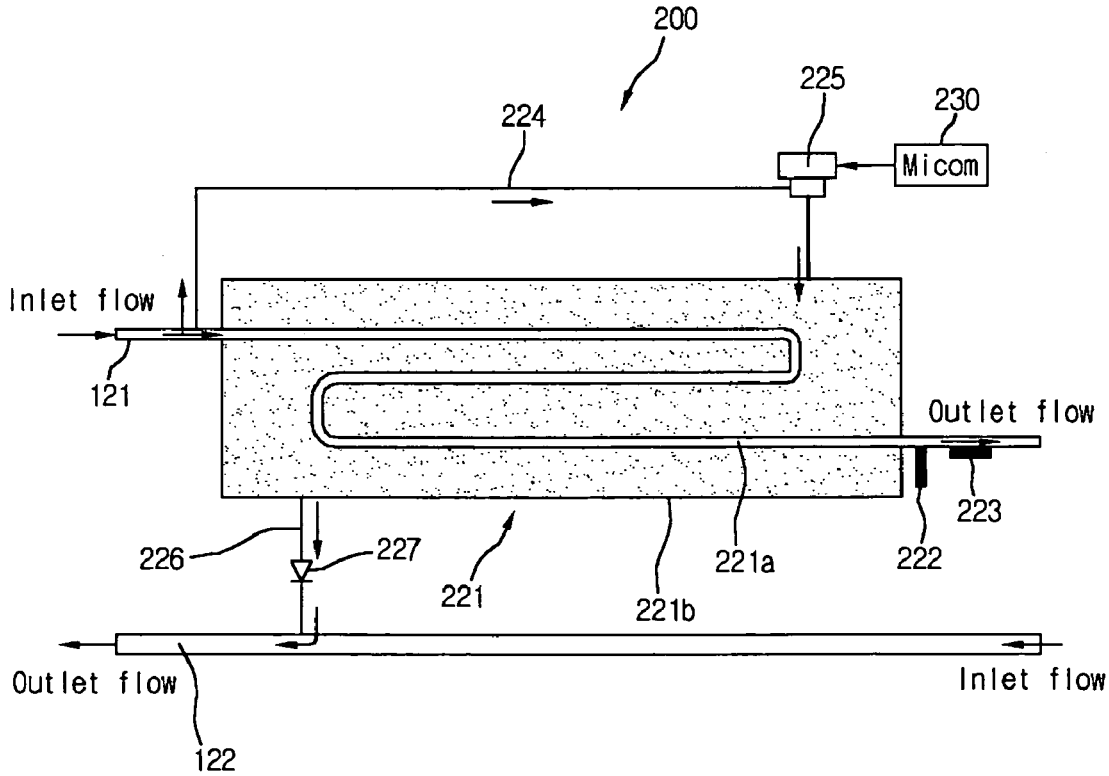
FIG. 6 is a view illustrating a further another construction of the supercooling degree control unit according to the first embodiment of the present invention.

FIGS. 4 to 6 are views illustrating constructions of various examples of a supercooling degree control unit 200 according to a first embodiment of the present invention.

Referring to FIG. 4, the superheating degree control unit 200 includes a heat exchanging unit 201; sensors 202 and 203; and a bypass pipe 204 and an EEV 205 for controlling the supercooling.

The heat exchanging unit 201 has an inner pipe 201*a* and an outer pipe 201*b*, which are correspondingly connected to and between a high-pressure pipe 121 and a low-pressure pipe 122. The inner pipe 201*a* has both ends connected to an inlet side and an outlet side of the high-pressure pipe 121, and it is bent to have a "ㄹ" shape. The outer pipe 201*b* has both ends connected to an inlet side and an outlet side of the low-pressure pipe 122, and it extends to an outside of the inner pipe 201*a* to allow a flow of a low-temperature and low-pressure refrigerant.

Here, the high-pressure pipe 121 is connected to the outdoor heat exchanger at its inlet side to introduce a two phase flow, and it is connected to the indoor EEV at its outlet side and discharge a liquid phase by heat exchange. The low-pressured pipe 122 is connected to the indoor heat exchanger at its inlet side and is connected at its outlet side to an inhalation side of the compressor.

Additionally, the supercooling degree sensing unit (not shown) includes a first temperature sensor 202 and a second temperature sensor 3. The first temperature sensor 202 is installed at the high-pressure pipe 121 of the inlet side of the heat exchanging unit 201, and the second temperature sensor 203 is installed at the high-pressure pipe 121 of the outlet side of the heat exchanging unit 201.

The first temperature sensor 202 senses the temperature of the high-pressure pipe 121 to sense a pressure of the high-pressure pipe 121, and senses a high-pressure saturation temperature on a Molier diagram. The second temperature sensor 203 senses the temperature corresponding to a current discharge temperature of the heat-exchanged high-pressure pipe 121.

Additionally, the supercooling degree control unit (not shown) includes the bypass pipe 204 branched from the high-pressure pipe 121 of the inlet side of the heat exchanging unit 201 to connect the high-pressure pipe 121 with the outer pipe 201*b*; the EEV 205 installed at an air passage of the bypass pipe 204 to control the flow amount of the refrigerant; and the microcomputer 203 for controlling the EEV 205.

Here, the branched bypass pipe 121 has a refrigerant temperature lower than a temperature of the refrigerant flowing to the high-pressure pipe 121 by a branch pressure.

At this time, the microcomputer 230 subtracts a second temperature sensed at the second temperature sensor 203 from a first temperature sensed from the first temperature sensor 202 to calculate the supercooling degree. The calculated supercooling degree increases and decreases an opening of the EEV 205 such that the calculated supercooling degree is consistent with the target supercooling degree.

By doing so, the high temperature and high-pressure refrigerant and a low temperature and low-pressure refrigerant are heat-exchanged by the temperature difference between the inner pipe 201*a* and the outer pipe 201*b* of the heat exchanging unit 201, and have the heat-exchanged amount of the heat exchanging unit 201 controlled by an amount of the refrigerant introduced into the bypass pipe 204.

Here, since the sensed first temperature is not an actual saturation temperature, it is compensated as much as a predetermined temperature to calculate the saturation temperature.

Additionally, the supercooling degree ($T_{SC}$) is obtained from the following Equation:

$$T_{SC}=Tin2-Tin1$$

where, $T_{SC}$ is a supercooling degree

Tin1: a first temperature sensed by the first temperature sensor 202

Tin2: second temperature sensed by the second temperature sensor 203.

FIG. 5 is a view illustrating another construction of the supercooling degree control unit 200 according to the first embodiment of the present invention. Descriptions of the same elements as those of FIG. 4 are omitted in the following.

Referring to FIG. 5, the supercooling sensing unit (not shown) includes a high-pressure sensor 212 and a temperature sensor 213 of the high-pressure pipe 121 of the outlet side of the heat exchanging unit 211. The supercooling sensing unit calculates the saturation temperature by using a high pressure sensed at the high-pressure sensor 212.

At this time, the microcomputer 230 subtracts the saturation temperature (condensation temperature) sensed at the high-pressure sensor 212 from the temperature sensed at the outlet-side temperature sensor 213, and controls the opening of the EEV 215 such that the obtained supercooling degree follows (or secures) the target supercooling degree.

Here, the supercooling degree ($T_{SC}$) is obtained from the following Equation:

$$T_{SC}=Tin-TL(Ps)$$

where, Tin: temperature sensed by the outlet-side temperature sensor

TL(Ps): pressure saturation temperature sensed by the high-pressure sensor.

FIG. 6 is a view illustrating a further another construction of the supercooling degree control unit 200 according to the first embodiment of the present invention.

Referring to FIG. 6, the heat exchanging unit 221 of the supercooling degree control unit 200 has a dual pipe structure, which has the inner pipe 221*a* connected to both ends of the high-pressure pipe 121 and the outer pipe 221*b* extended to the exterior of the inner pipe 221*a*.

Additionally, the supercooling degree sensing unit includes the high-pressure sensor 222 and the temperature sensor 223 disposed at the outlet-side high-pressure pipe 121 of the heat exchanging unit 221. The supercooling degree control unit includes a bypass pipe 224 branched from the high-pressure pipe 121; an EEV 225 for controlling an amount of refrigerant; a high-pressure refrigerant inlet pipe 225 connected with the outer pipe 221*b* of the dual pipe; and a check valve 227 or a bypass valve being one-directional refrigerant inlet unit.

The microcomputer 230 of the supercooling degree control unit senses the supercooling by using the high-pressure sensor 222 and the temperature sensor 223. The microcomputer 230 controls the opening of the EEV 225 depending on the sensed result to heat-exchange the high temperature and high-pressure refrigerant of the inner pipe 221*a* with a middle temperature and high-pressure refrigerant, which is branched from the high-pressure pipe 121, of the outer pipe 221*b*.

Here, the bypass pipe 224 branched from the high-pressure pipe 121 has a refrigerant temperature lower than a temperature of a refrigerant flowing due to the branch pressure in the high-pressure pipe 121, thereby achieving a heat exchange at the heat exchanging unit.

Further, the high-pressure refrigerant flowing in the outer pipe 221*b* of the heat exchanging unit 221 is introduced into the low-pressure pipe 123 through a high-pressure refrigerant inlet pipe 226 by opening the check valve 227. At this time, the refrigerant flowing in the outer pipe 211*b* of the heat exchanging unit 221 is in a high-pressure and the refrigerant flowing in the low-pressure pipe 122 is in a low-pressure. Therefore, the high-pressure refrigerant of the high-pressure refrigerant inlet pipe 226 flows to the low-pressure pipe 122 by a pressure difference.

Here, the supercooling degree ($T_{SC}$) is obtained from the following Equation:

$$T_{SC}=Tin-TL(Ps)$$

where, Tin: discharge temperature sensed by the outlet-side temperature sensor 223 of the high-pressure pipe TL(Ps): pressure saturation temperature sensed by the high-pressure sensor 222.

Second Embodiment

Figure 7:
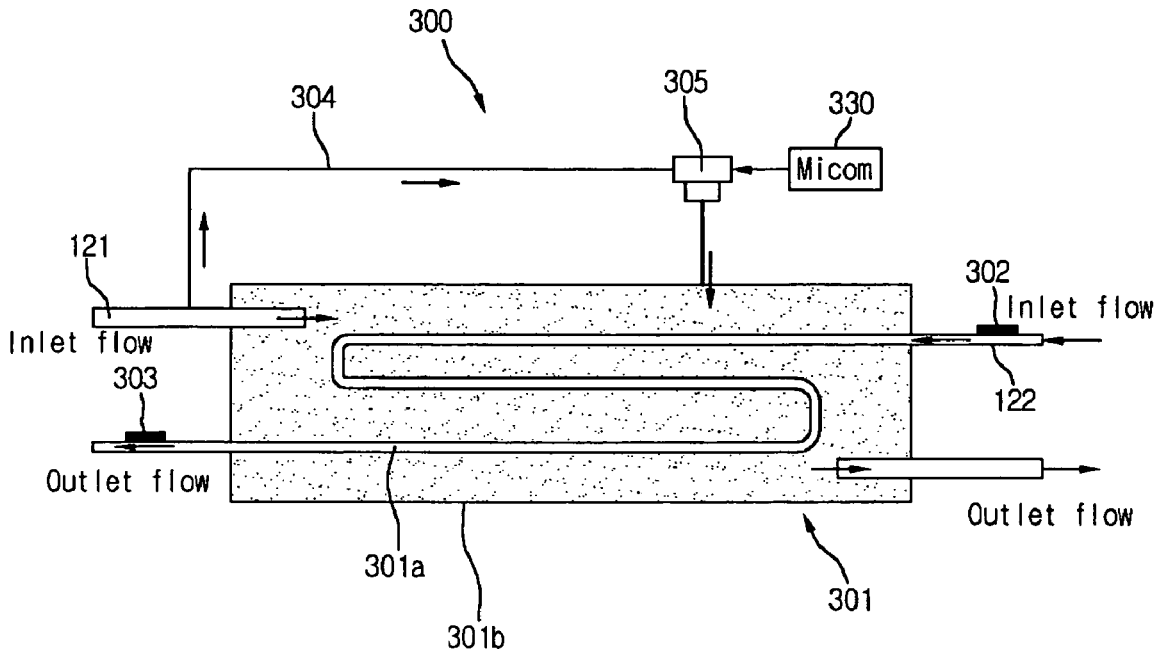
FIG. 7 is a view illustrating a construction of a superheating degree control unit according to a second embodiment of the present invention.
Figure 8:
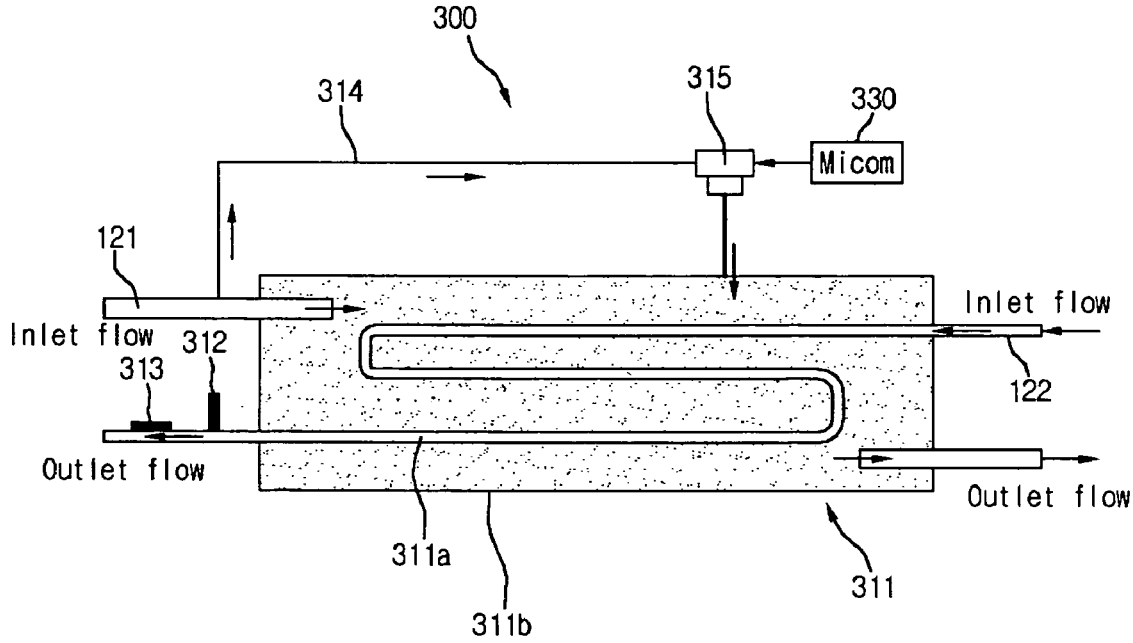
FIG. 8 is a view illustrating another construction of the superheating degree control unit according to the second embodiment of the present invention.
Figure 9:
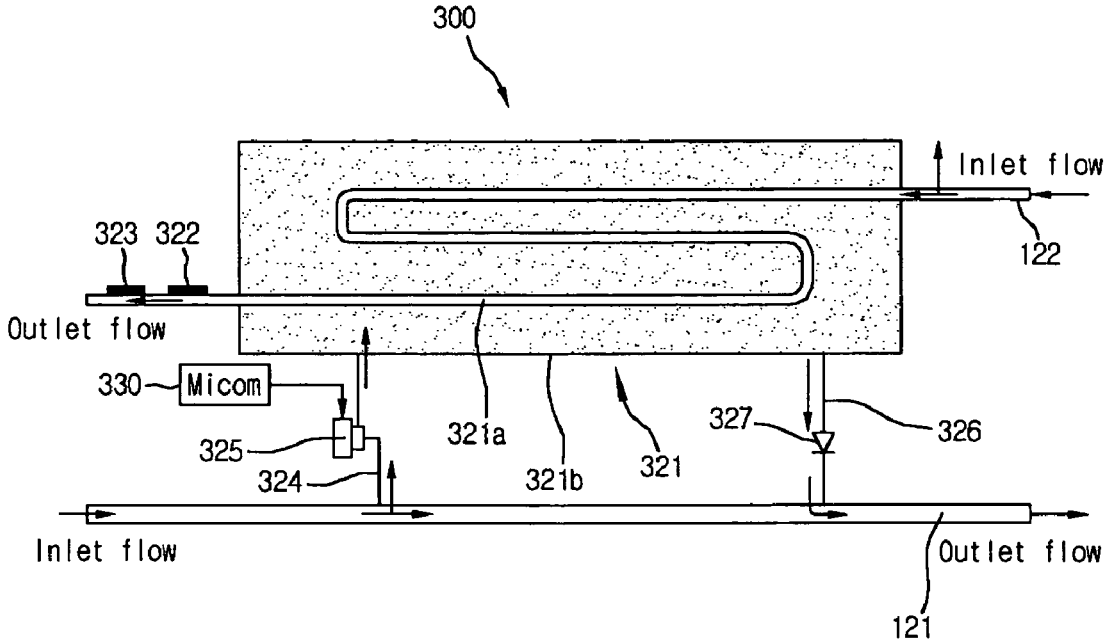
FIG. 9 is a view illustrating a further another construction of the superheating degree control unit according to the second embodiment of the present invention.

FIGS. 7 to 9 are views illustrating constructions of various examples of a superheating degree control unit 300 according to a second embodiment of the present invention.

Referring to FIG. 7, the superheating control unit 300 has an inner pipe 301*a* and an outer pipe 301*b* connected with each other between a high-pressure pipe 121 and a low-pressure pipe 122. The inner pipe 301*a* of the heat exchanging unit 301 has both ends connected to an inlet side and an outlet side of the low-pressure pipe 122 and is bent to have a "ㄹ" shape. The outer pipe 301*b* has both ends connected to an inlet side and an outlet side of the high-pressure pipe 121. A high temperature and low-pressure refrigerant flows through an outside of the inner pipe 301*a*.

Additionally, the superheating degree sensing unit includes temperature sensors 302 and 303. The first sensor 302 is installed at the inlet-side low-pressure pipe 122 of the heat exchanging unit 301, and the second temperature sensor 303 is installed at the outlet-side low-pressure pipe 122.

The first temperature sensor 302 senses a pressure of the low-pressure pipe 122 and senses a low-pressure side saturation temperature on Molier diagram. The second temperature sensor 303 senses a current temperature of the discharged refrigerant of the heat-exchanged low-pressure pipe 122.

Additionally, the superheating degree control unit includes a bypass pipe 304, an EEV 305 and a microcomputer (not shown). The bypass pipe is branched from the inlet-side low-pressure pipe 122 of the heat exchanging unit 301 to be connected to the low-pressure pipe 122 and an inside of the outer pipe 301*b*. The EEV 305 is installed at a predetermined passage of the bypass pipe 304 to control an amount of the refrigerant flowing to the inside of the outer pipe 301*b* through the bypass pipe 304.

At this time, the microcomputer 330 subtracts the second temperature sensed at the second temperature sensor 303 from the first temperature sensed at the first temperature sensor 302 to calculate the superheating degree ($T_{SH}$) to control the superheating degree. An opening of the electronic expansion value 305 is increased and decreased such that the calculated superheating degree is consistent with a target superheating degree. Accordingly, a heat-exchange amount is controlled by the refrigerant introduced into the bypass tube 304 and due to a temperature difference between the high temperature and high-pressure refrigerant, which flows through the inner pipe 301*a*, and the low temperature and low-pressure refrigerant, which flows through the outer pipe 301*b*.

In other words, if the current superheating degree is less than the target superheating degree, the opening of the EEV 305 is increased such that the heat-exchange amount is increased at the heat exchanging unit 301 to increase the current superheating degree. To the contrary, if the current superheating degree is more than the target superheating degree, the opening of the EEV 305 is decreased such that the heat-exchange amount is decreased at the heat exchanging unit 301 to decrease the current superheating degree.

Here, since the first temperature sensed at the first temperature sensor 302 is not an actual saturation temperature, it is compensated as much as a predetermined temperature to calculate the saturation temperature.

Additionally, the superheating degree (Tsh) is obtained in the following Equation:

$$Tsh = Tout2 - Tout1$$

where,

Tsh: superheating degree

Tout1: first temperature

Tout2: second temperature.

FIG. 8 is a view illustrating another construction of the superheating degree control unit 300 according to the second embodiment of the present invention.

As shown in FIG. 8, the superheating degree sensing unit includes a low-pressure sensor 312 and a temperature sensor 313 of an outlet-side low-pressure pipe 122 of the heat exchanging unit 311. The low-pressure sensor 312 calculates a saturation temperature by using the low-pressure sensed by the low-pressure sensor 312.

At this time, the microcomputer 330 subtracts the saturation temperature (condensation temperature) from the temperature sensed from the outlet-side temperature sensor 313 to obtain the superheating degree, and increases and decreases to control the opening of the EEV 315 such that the obtained superheating degree follows the target superheating degree.

Here, the superheating degree (Tsh) is obtained in the following Equation:

$$Tsh = Tout - TL(Ps)$$

where,

Tout: temperature sensed at the outlet-side temperature sensor

TL(Ps): saturation temperature of the pressure sensed at the low-pressure sensor.

FIG. 9 is a view illustrating a further another construction of the superheating degree control unit 300 according to the second embodiment of the present invention.

As shown in FIG. 9, the heat exchanging unit 331 of the superheating degree control unit 300 is configured in a dual pipe to connect the low-pressure pipe 122 to both ends of the inner pipe 321*a* and to connect refrigerant inlet and outlet pipes 326*a* and 326*b* to both ends of the outer pipe 321*b*.

Additionally, the superheating degree sensing unit includes a low-pressure sensor 322 and a temperature sensor of an outlet-side low-pressure pipe 122.

Additionally, the superheating degree control unit includes an EEV 327, a check valve 327*b* and the microcomputer 330. The EEV 327 is installed at the refrigerant inlet pipe 326*a* connected between the high-pressure pipe 121 and the outer pipe 321*b*. The check valve 327*b* is installed at the refrigerant outlet pipe 326*b* of the refrigerant flowing from the outer pipe 321*b* to the high-pressure pipe 121.

Additionally, the high-pressure sensor 322 and the temperature sensor 323 are used to sense the current superheating degree, and the opening of the EEV 327*a* is increased and decreased depending on the sensed result to control the current superheating degree to follow the target superheating degree and control the heat-exchange amount of the heat exchanging unit 321.

In other words, the refrigerant introduced into the outer pipe 321*b* through the bypass pipe 324 is varied in amount depending on an opening control of the EEV 325 to control the heat-exchange amount of the heat exchanging unit 321 and the superheating degree. At this time, the high-pressure refrigerant flowing through the outer pipe 321*b* of the heat exchanging unit 321 is again introduced into the high-pressure pipe 121 by the check valve 327.

Here, the superheating degree (Tsh) is obtained in the following Equation:

$$Tsh = Tout - TL(Ps)$$

where,

Tout: temperature sensed at the outlet-side temperature sensor of the low-pressure pipe TL(Ps): saturation temperature of the pressure sensed at the outlet-side low-pressure sensor of the low-pressure pipe.

Third Embodiment

Figure 10:
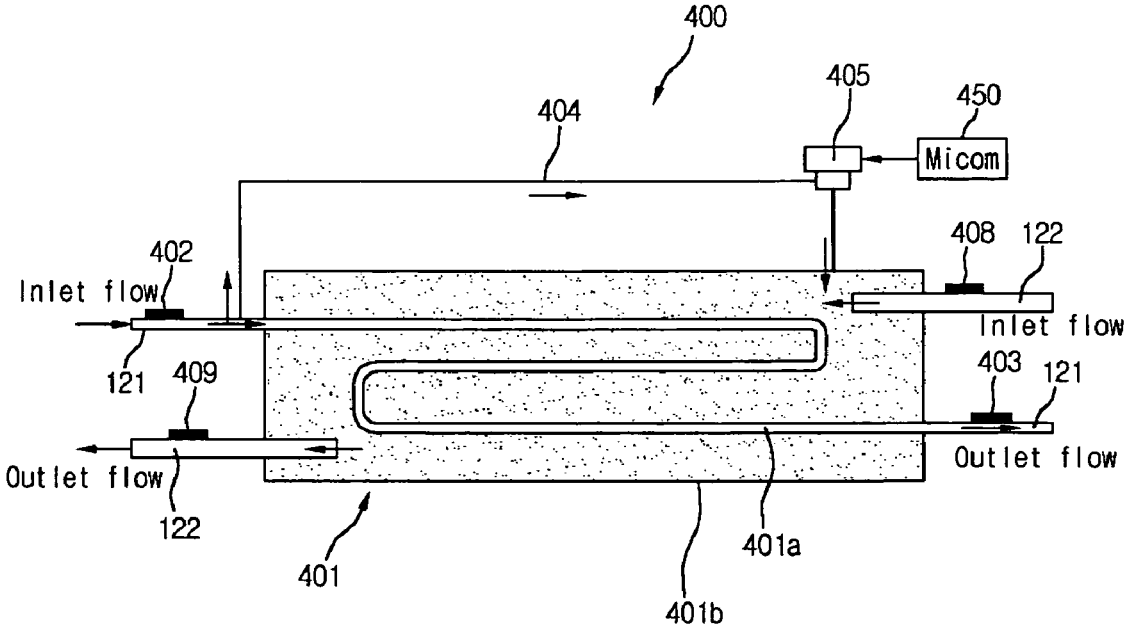
FIG. 10 is a view illustrating a construction of a supercooling/superheating degree control unit according to a third embodiment of the present invention.
Figure 11:
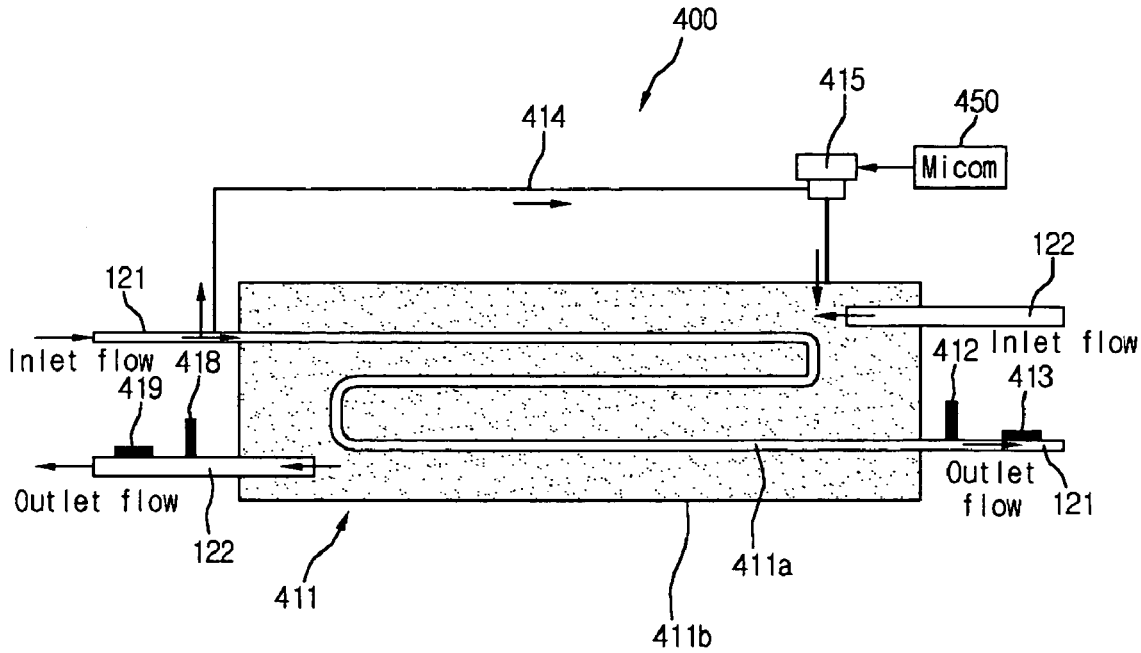
FIG. 11 is a view illustrating another construction of the supercooling/superheating degree control unit according to the third embodiment of the present invention.
Figure 12:
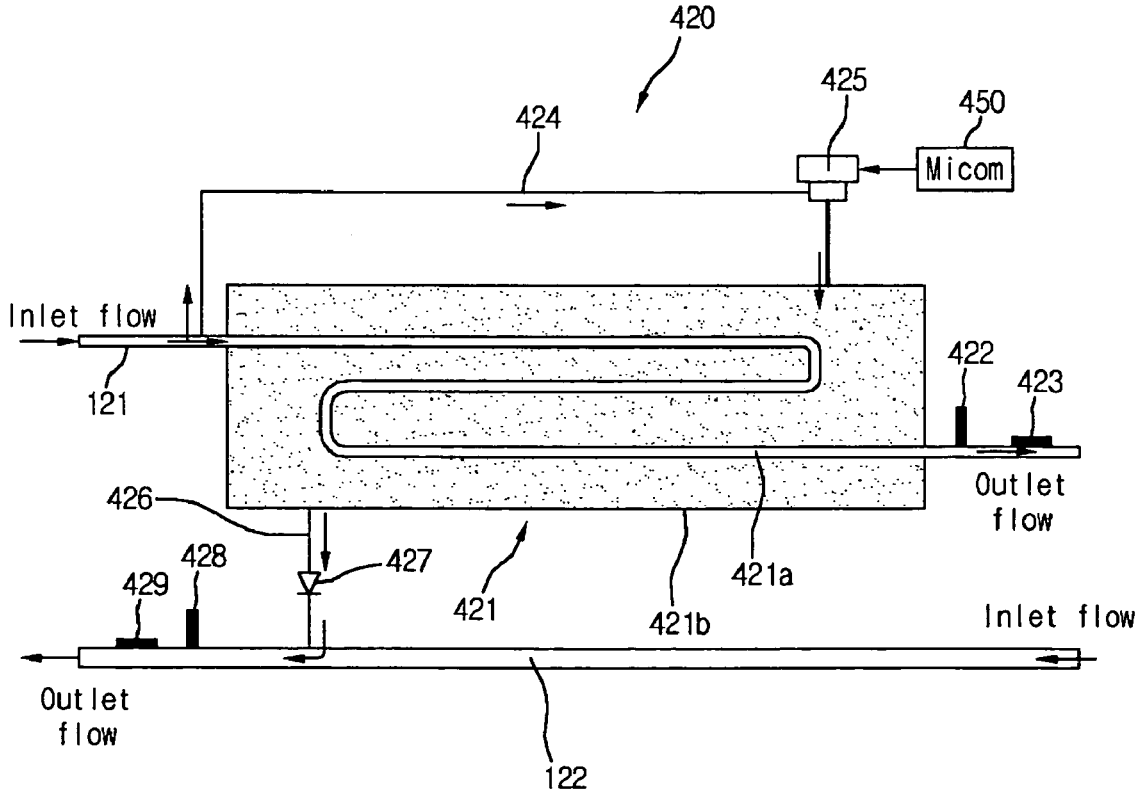
FIG. 12 is a view illustrating a further another construction of the supercooling/superheating degree control unit according to the third embodiment of the present invention.

FIGS. 10 to 12 are views illustrating constructions of a supercooling/superheating degree control unit 400 according to a fourth embodiment of the present invention.

Referring to FIG. 10, a heat exchanging unit 401 has a dual pipe structure of an inner pipe 401*a* and an outer pipe 401*b* to perform a refrigerant heat exchange therein. The inner pipe 401*a* has both ends connected to a high-pressure pipe 121, and the outer pipe 401*b* has both ends connected to a low-pressure pipe 122.

Additionally, the supercooling/superheating degree sensing unit (not shown) includes a plurality of temperature sensors 402, 403, 408 and 409, that is, an inlet-side first temperature sensor 402 and an outlet-side second temperature sensor 403 of a high-pressure pipe 121; and an inlet-side third temperature sensor 408 and an outlet-side fourth temperature sensor 409 of a low-pressure pipe 122.

Here, the first temperature sensor 402 senses a temperature for calculating a saturation condensation temperature, the third temperature sensor 408 senses a temperature for calculating a saturation evaporation temperature, the second temperature sensor 403 senses a temperature of a heat-exchanged high-pressure pipe 121, and the fourth temperature sensor 409 senses a temperature of a heat-exchanged low-pressure pipe 122.

Additionally, the supercooling/superheating degree control unit (not shown) includes a bypass pipe 404 branched at an inlet side of the high-pressure pipe 121 to be connected to the outer pipe 401*b*; an EEV 405 installed at the bypass pipe 404 to control an amount of the high-pressure refrigerant; and a microcomputer 450.

In order to concurrently control the supercooling/superheating degrees, the microcomputer 450 subtracts the temperature sensed at the first temperature sensor 402 from the temperature sensed at the second temperature sensor 403 to detect the supercooling degree, and subtracts the temperature sensed at the third temperature sensor 408 from the temperature sensed at the fourth temperature sensor 409 to detect the superheating degree.

According to a condition of satisfying all of the detected supercooling and superheating degrees, the opening of the EEV 405 is increased and decreased to control a heat exchange degree of the heat exchanging unit 401.

In other words, the condition of satisfying all of the detected supercooling and superheating degrees is obtained as follows:

$$Tout1<Tout2<Tin1<T_{HEX}<Tin2$$

where,

Tout1: temperature of the outlet-side third temperature sensor of the low-pressure pipe 122

Tout2: temperature of the outlet-side fourth temperature sensor of the low-pressure pipe 122

$T_{HEX}$: internal temperature of the heat exchanging unit

Tin1: temperature of the outlet-side first temperature sensor of the high-pressure pipe Tin2: temperature of the outlet-side second temperature sensor of the high-pressure pipe.

Under the above condition, the supercooling degree of the high-pressure pipe 121 introduced into the indoor unit can be secured, and the superheating degree of the low-pressure pipe 122 introduced into the outdoor unit can be secured.

FIG. 11 is a view illustrating another construction of the supercooling/superheating degree control unit 400 according to the third embodiment of the present invention.

Referring to FIG. 11, a heat exchanging unit 411 includes an inner pipe 411*a* having both ends connected to a high-pressure pipe 121; and an outer pipe 411*b* having both ends connected to a low-pressure pipe 122 to perform a heat exchange between the refrigerants flowing through the inner pipe and the outer pipe.

Additionally, the supercooling/superheating degree sensing unit (not shown) includes a plurality of temperature sensors 413 and 419, and pressure sensors 412 and 418. That is, it includes an outlet-side first pressure sensor 412 and first temperature sensor 413 of the pressure pipe 121; and an outlet-side second pressure sensor 418 and second temperature sensor of a low-pressure pipe. The first pressure sensor 412 is a high-pressure sensor, and the second pressure sensor 418 is a low-pressure sensor.

Here, a saturation condensation temperature is calculated from a high-pressure sensed at the first pressure sensor 412, a saturation evaporation temperature is calculated from a high-pressure sensed at the second pressure sensor 418, the first temperature sensor 413 senses a temperature of the heat-exchanged high-pressure pipe 121, and the second temperature sensor 419 senses the temperature of the heat-exchanged low-pressure pipe 122.

The supercooling/superheating degree control unit (not shown) includes a bypass pipe 414 branched from the inlet side of the high-pressure pipe 121 to be connected to the outer pipe 411*b*; an EEV 415 installed at the bypass pipe 414 to control an amount of the high-pressure refrigerant; and a microcomputer 450.

In order to concurrently control the supercooling/superheating degrees, the microcomputer 450 subtracts the saturation temperature sensed at the first pressure sensor 412 from the temperature sensed at the first temperature sensor 413 to detect the supercooling degree, and subtracts the saturation temperature sensed at the second temperature sensor. 418 from the temperature sensed at the second temperature sensor 419 to detect the superheating degree.

According to a condition of satisfying all of the detected supercooling and superheating degrees, the opening of the EEV 415 is increased and decreased to control a heat exchange degree of the heat exchanging unit 411.

In other words, the condition of satisfying all of the detected supercooling and superheating degrees is obtained as follows:

$$Tout1<Tout2<Tin1<T_{HEX}<Tin2$$

where,

Tout1: low-pressure saturation temperature of the low-pressure pipe

Tout2: temperature of the outlet-side second temperature sensor of the low-pressure pipe $T_{HEX}$: internal temperature of the heat exchanging unit 411

Tin1: saturation temperature of the outlet-side first pressure sensor of the high-pressure pipe Tin2: temperature of the outlet-side first temperature sensor of the high-pressure pipe.

Under the above condition, the supercooling degree of the high-pressure pipe 121 introduced into the indoor unit can be secured, and the superheating degree of the low-pressure pipe 122 introduced into the outdoor unit can be secured.

FIG. 12 is a view illustrating a further another construction of the supercooling/superheating degree control unit 400 according to the third embodiment of the present invention.

Referring to FIG. 12, the heat exchanging unit 421 of the supercooling/superheating degree control unit 400 include a high-pressure pipe 121 connected to both ends of an inner pipe 421*a* and an outer pipe 421*b*.

The supercooling/superheating control unit controls a heat-exchange amount through a bypass pipe 424 branched from the high-pressure pipe 121 and the EEV 425, and connects the outer pipe 421*b* of the heat exchanging unit 421 with the low-pressure pipe 122 by a check valve 427.

Additionally, the supercooling/superheating degree sensing unit includes outlet-side first pressure sensor 422 and first temperature sensor 423 of a high-pressure pipe 121, and outlet-side second pressure sensor 428 and second temperature sensor 429 of a low-pressure pipe.

The microcomputer 450 of the supercooling/superheating control unit-detects the supercooling degree by using the outlet-side first pressure sensor 422 and first temperature sensor 423 of the high-pressure pipe 121, and detects the superheating degree by using the outlet-side second pressure sensor 428 and second temperature sensor 429 of the low-pressure pipe.

Additionally, the supercooling/superheating control unit includes a high-pressure refrigerant inlet pipe 426 connected with the outer pipe 421*b* of a dual pipe; and a check valve 427 as one directional refrigerant inlet unit, to control the superheating degree of the low-pressure pipe 122.

The microcomputer 450 calculates the supercooling degree by using the first pressure sensor 422 and the first temperature sensor 423 of the supercooling degree sensing unit. The microcomputer 450 controls an increase or a decrease of the opening of the EEV 425 according to the calculated superheating degree to control the heat-exchange amount between the high-pressure refrigerant branched from the high-pressure pipe 121 to flow into the outer pipe 421*b* and the high-pressure refrigerant flowing to the inner pipe 421*a*.

Concurrently, according to the superheating degree calculated from the second pressure sensor 428 and the second temperature sensor 429, the opening of the EEV 425 is controlled such that the check valve 427 is opened to allow the high-pressure refrigerant flowing into the outer pipe

421*b* of the heat exchanging unit 421 to flow into the low-pressure pipe 122 through a high-pressure refrigerant inlet pipe 426. At this time, since the outer pipe 421*b* of the heat exchanging unit 421 is in a high pressure, and the low-pressure pipe 122 is in a low-pressure, the high-pressure refrigerant of the high-pressure refrigerant inlet pipe 426 is transmitted to the low-pressure pipe 122 due to a pressure difference to secure the superheating degree.

In other words, the condition of satisfying all of the detected supercooling and superheating degrees is obtained as follows:

$$T\text{out}1<T\text{out}2<T\text{in}1<T_{HEX}<T\text{in}2$$

where,

Tout1: saturation temperature sensed at the outlet-side second pressure sensor of the low-pressure pipe Tout2: temperature of the outlet-side second temperature sensor of the low-pressure pipe $T_{HEX}$: internal temperature of the heat exchanging unit Tin1: high-pressure saturation temperature of the inlet-side first pressure sensor of the high-pressure pipe Tin2: temperature of the outlet-side second temperature sensor of the high-pressure pipe.

Under the above condition, the supercooling degree of the high-pressure pipe 121 introduced into the indoor unit can be secured, and the superheating degree of the low-pressure pipe 122 introduced into the outdoor unit can be secured.

Figure 13:
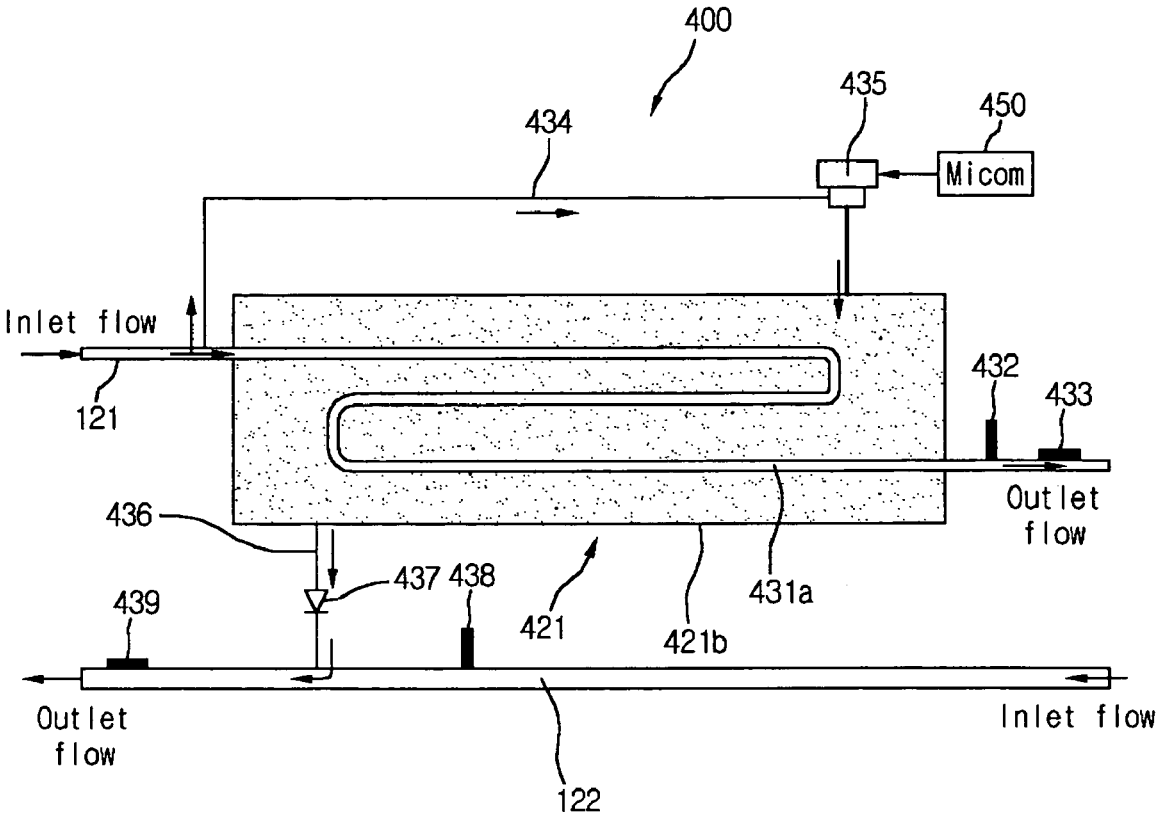
FIG. 13 is a view illustrating a still further another construction of the supercooling/superheating degree control unit according to the third embodiment of the present invention.

FIG. 13 is a view illustrating a still another construction of the supercooling/superheating degree control unit 400 according to the third embodiment of the present invention.

Referring to FIG. 13, the superheating degree control unit detects an inlet-side temperature (T121) of a high-pressure pipe 121 and a temperature (T433) sensed by an outlet-side temperature sensor 433 of a heat-exchanged high-pressure pipe, and obtains an internal temperature (THEX) of the heat exchanging unit 431.

Further, a temperature (T438) sensed by an inlet-side third temperature sensor 438 of the low-pressure pipe 122 and a temperature (T439) sensed by a fourth temperature sensor 439 of the heat-exchanged low-pressure pipe 122 are obtained. Here, in order to concurrently secure the superheating degree and the supercooling degree, the supercooling degree and the superheating degree are concurrently controlled to be in a sequence of T428<T429<THEX<T423<T121.

Here, the inlet-side temperature of the high-pressure pipe 121 and the internal temperature of the heat exchanging unit 431 can be respectively sensed using a temperature sensor, and the temperature sensor is installed only at a side of the high-pressure pipe to sense the internal temperature of the heat exchanging unit by using a temperature difference of before/after a heat exchange.

Fourth Embodiment

Figure 14:
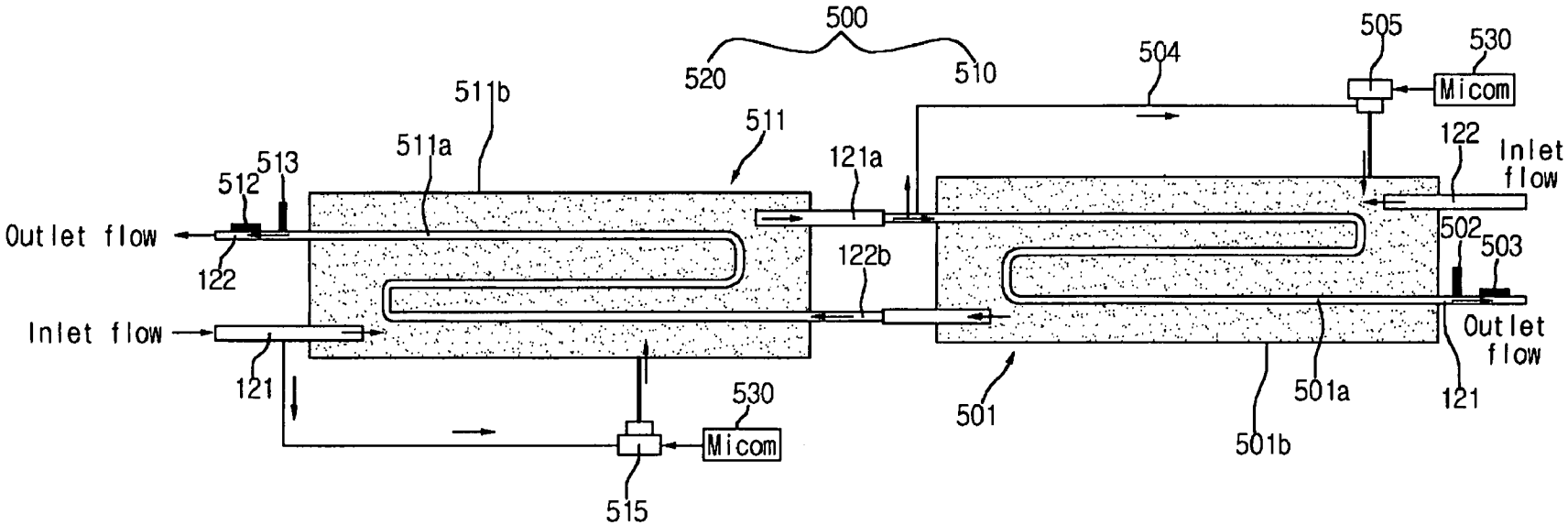
FIG. 14 is a view illustrating a construction of a supercooling/superheating degree control unit according to a fourth embodiment of the present invention.

FIG. 14 is a view illustrating a construction of the supercooling/superheating degree control unit 400 according to a fourth embodiment of the present invention.

Referring to FIG. 14, a refrigerant temperature control unit 500 is comprised of a supercooling degree control unit 510 and a superheating degree control unit 520. The supercooling degree control unit 510 is installed at a side of an indoor unit, and the superheating degree control unit 520 is installed at a side of an outdoor unit.

The supercooling degree control unit 510 detects the supercooling degree by using a first pressure sensor 502 and a first temperature sensor 503. Since a high-pressure connection pipe 121*a* of a heat exchanging unit 501 is connected with a high-pressure pipe 121 through an inner pipe 501*a*, a bypass pipe 504 branched from the high-pressure connection pipe 121*a* is connected to an outer pipe 501*b*.

At this time, a microcomputer 530 calculates a current supercooling degree to control an increase or decrease of an opening of an EEV 505 such that the current supercooling degree is consistent with the target supercooling degree. Accordingly, an amount of refrigerant flowing through the outer pipe 501*b* is controlled.

Additionally, the microcomputer 530 detects the current superheating degree by using a second pressure sensor 512 and a second temperature sensor 513. A bypass pipe 514 branched from the high-pressure pipe 121 of the heat exchanging unit controls an amount of refrigerant applied to the outer pipe 511*b* by controlling the opening of the EEV 515. This superheating degree control operation is as described above.

In other words, according to the fourth embodiment of the present invention, the supercooling degree control unit is installed at the indoor unit to secure the supercooling degree of the high-pressure pipe, and the superheating degree control unit is installed at the outdoor unit to secure the superheating degree of the low-pressure pipe. These control units are preferably installed as a single unit.

Figure 15:
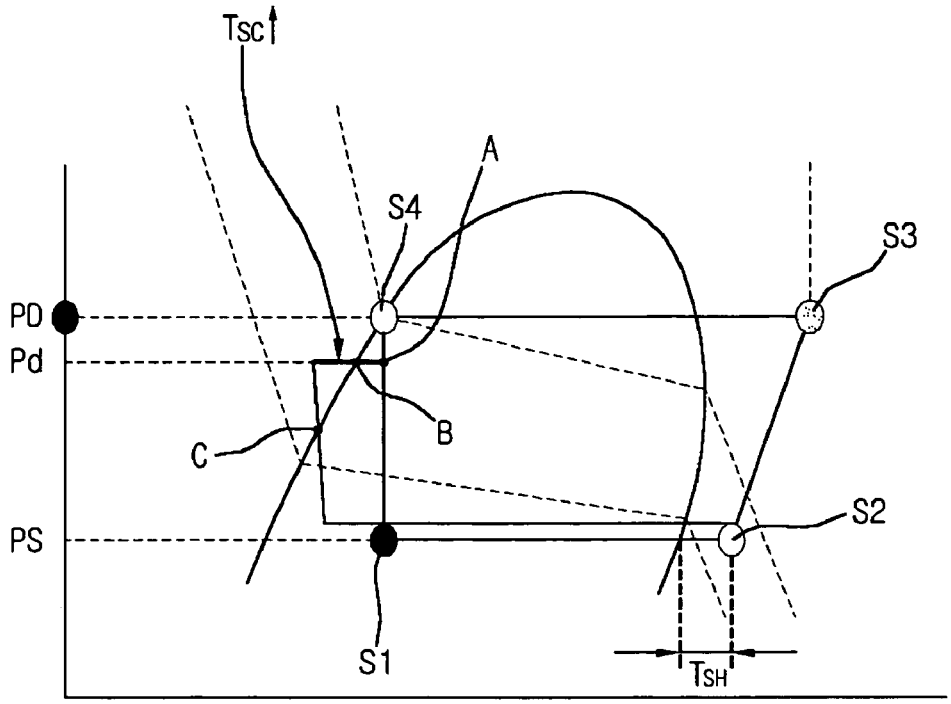
FIG. 15 is a p-h bode plot illustrating a principle of securing the supercooling/superheating degrees according to the embodiments of the present invention.

FIG. 15 illustrates a Molier diagram on which the supercooling degree is increased by the inventive superheating degree control unit. In FIG. 15, a dotted line and a solid line illustrate the Molier diagrams caused by refrigerants different from each other.

The supercooling degree control unit secures the supercooling degree of the refrigerant heat-exchanged at the outdoor heat exchange and introduced into the EEV. Therefore, a temperature point (A) sensed at the temperature sensor is compensated up to a saturation temperature point (B) and then, the supercooling degree of a high-pressure (Pd) saturation point is increased by the supercooling degree control unit. Accordingly, at the Pd point, the supercooling degree at the outlet side is secured in the outdoor heat exchanger. Additionally, the Molier diagram is increased up to an inlet-side temperature (C) of the indoor EEV.

Additionally, the inlet-side superheating degree ($T_{SH}$) of the compressor can be secured. Here, "S1" denotes a temperature point sensed at a pipe temperature sensor of an indoor entrance under a low-pressure (Ps), "S2" denotes a temperature sensed at a pipe temperature sensor of an indoor exit, "S3" denotes a temperature sensed at a discharge pipe temperature sensor under a high pressure (PD), and "S4" denotes a temperature sensed at an outlet-side pipe temperature sensor of an outdoor heat exchanger.

Figure 16:
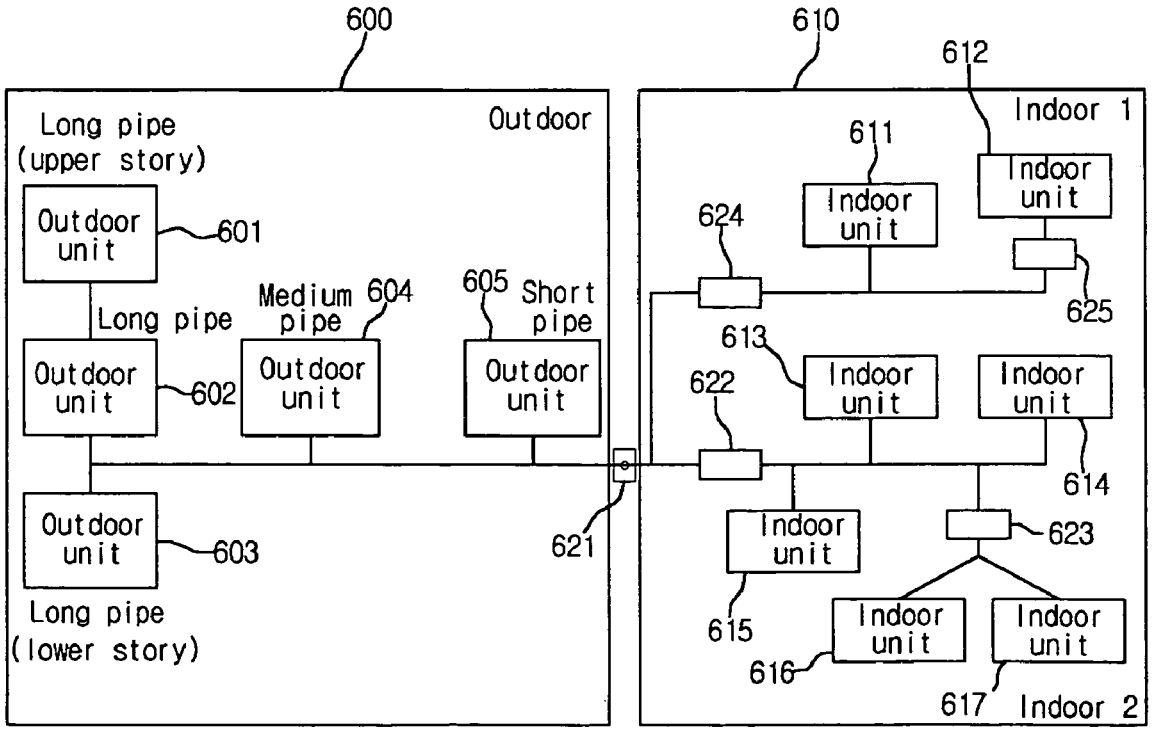
FIG. 16 is a view of an air conditioner including the system for controlling a temperature of a refrigerant according to the present invention.

FIG. 16 illustrates an application example of the system according to the present invention.

Referring to FIG. 16, at least one outdoor unit 601 to 605 connected by long, medium and short pipes is installed at the outdoors 600. At least one indoor unit 611 to 617 is installed at each of indoor room 610. Accordingly, according to an operation condition, a multi air conditioner for a combined cooling and heating is provided for selectively performing an all-room cooling operation, an all-room heating operation, a cooling-based concurrent cooling and heating operation, and a heating-based concurrent cooling and heating operation.

The refrigerant temperature control units 621, 622, 623, 624 and 625, which are installed at a predetermined position between the pipes of the air conditioner, are installed between the indoor unit and the outdoor unit, or respectively installed at an entrance of a bridge type indoor unit and at a front of the indoor unit. Each of the refrigerant temperature control units 621, 622, 623, 624 and 625 is controlled such that the supercooling degree and the superheating degree are consistent with the target temperature on the pipe between the indoor unit and the outdoor unit.

Figure 17:
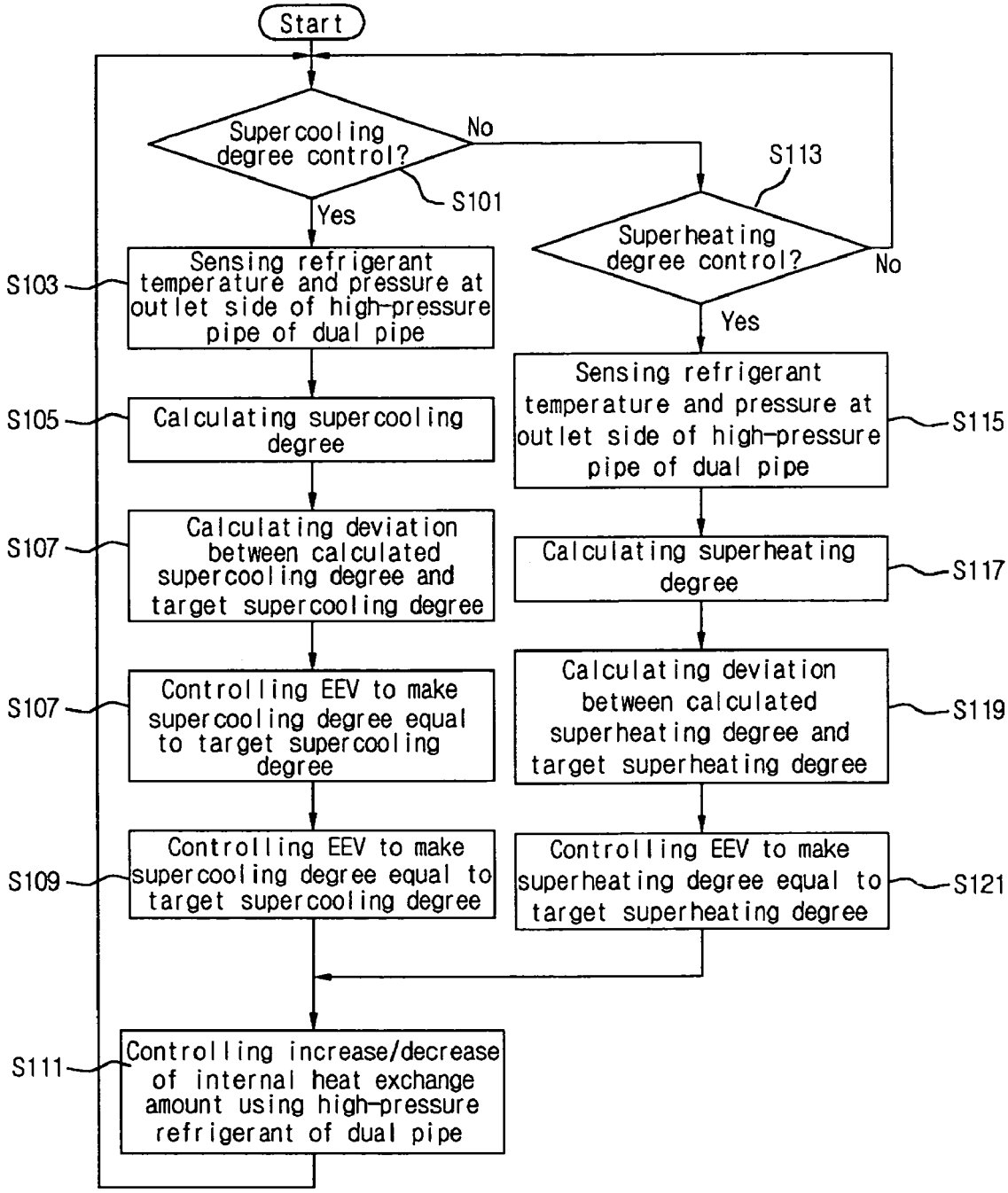
FIG. 17 is a flowchart illustrating a method for controlling a temperature of a refrigerant in an air conditioner according to an embodiment of the present invention.

FIG. 17 illustrates a method for controlling a refrigerant temperature according to a preferred embodiment of the present invention.

Referring to FIG. 17, it is determined to control a refrigerant temperature whether the supercooling degree is controlled or the superheating degree is controlled (S101, S113). At this time, this determination can be different depending on any priority for the supercooling degree and the superheating degree. In other words, in a cooling operation mode, the superheating degree is first controlled, and in a heating operation mode, the supercooling degree is first controlled.

Additionally, in case that the supercooling degree is controlled, the outlet-side refrigerant temperature and high pressure of the heat exchanging unit (for example, dual pipe) are sensed (S103), and the sensed pressure and temperature are used to sense the current supercooling degree (S105).

The sensed supercooling degree is compared with a predetermined target supercooling degree to detect the deviation therebetween (S107). The opening of the EEV is controlled to reduce the detected deviation such that the current supercooling degree is consistent with the target supercooling degree (S109). At this time, an internal heat-exchange amount is increased or decreased due to the high-pressure refrigerant of the dual pipe, which is the heat exchanging unit to secure the supercooling degree (S111).

Meanwhile, in case that the superheating degree is controlled (S113), the refrigerant temperature and pressure are sensed at the outlet side of the low-pressure pipe of the dual pipe (S115), and the current superheating degree is calculated (S117). If the superheating degree is calculated, the deviation between the current superheating degree and the target superheating degree is obtained (S119). After that, the opening of the EEV is controlled such that the current superheating degree is consistent with the target superheating degree to reduce the deviation (S121). At this time, the internal heat-exchange amount is increased or decreased due to the high-pressure refrigerant of the dual pipe to secure the superheating degree (S111).

As described above, the present invention can solve the installation position of the temperature sensor and the pressure sensor by using a specific sensing unit for performing an accurate sensing irrespective of an inside/outside of the pipe, can use the sensed temperature of the heat exchanging unit, and can use the temperature difference of before/after the heat exchange of the pipe.

Further, the present invention can secure the supercooling degree/the superheating degree by controlling the supercooling degree/the superheating degree for a refrigerant flowing cycle for a cooling operation, and for an oppositely flowing cycle for a heating operation.

As described above, the inventive temperature control unit and method of a refrigerant air conditioner controls the temperature of the refrigerant between the indoor unit and the outdoor unit to selectively control to secure the supercooling degree of the refrigerant flowing to the indoor unit or the superheating degree of the refrigerant flowing to the outdoor unit, and to concurrently control the supercooling degree and the superheating degree, thereby securing the supercooling degree and the superheating degree irrespective of a characteristic of an operation cycle.

Furthermore, the present invention has an effect in that the supercooling degree and the superheating degree are secured, thereby reducing a refrigerant noise. Specifically, a supercooling effect is remarkable in the long pipe.

Additionally, the present invention has an effect in that a module type is installed before and after the header and the branch, thereby achieving a simple installation without disassembling the indoor unit and the outdoor unit. Further, the present invention has an effect in that an independent control can be performed by an independent power supply even without the communication between the indoor unit and outdoor unit.

Further, the present invention has an effect in that the superheating degree can be secured during the cooling operation, thereby preventing a freezing and a fluid compression, in that in case that there is an excessive mass flow such as a weak wind operation of the air conditioner, the mass flow can be controlled.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A system for controlling a temperature of refrigerant in an air conditioner, comprising:

at least one indoor unit;

at least one outdoor unit;

a high-pressure pipe and a low-pressure pipe which connect the at least one indoor unit and the at least one outdoor unit; and a refrigerant temperature control unit coupled to the high-pressure pipe and the low-pressure pipe, which performs a heat exchange with respect to flowing refrigerants by coupling an inner pipe to an outer pipe, the inner pipe passing through the outer pipe, the refrigerant temperature control unit installed in one side of one of the high-pressure pipe and the low-pressure pipe, to sense one of a supercooling degree and a superheating degree and to increase or decrease a refrigerant inlet flow to the outer pipe through a bypass passage, which couples the outer pipe to a specific pipe, so as to make the sensed supercooling or superheating degree equal to a target value.

2. The system according to claim 1, wherein the refrigerant temperature control unit comprises:

a heat exchanging part including an inner pipe whose both ends are coupled to the high-pressure pipe and an outer pipe whose both ends are coupled to the low-pressure pipe, the inner pipe being bent in a predetermined shape, the outer pipe being extended to an outside of the inner pipe, such that heat is exchanged due to a difference in temperature of a refrigerant flowing inside the inner pipe and the outer pipe;

a supercooling degree sensing part for sensing a supercooling of a refrigerant flowing through a high-pressure pipe disposed at one side of the heat exchanging part; and a supercooling degree control unit for controlling a heat exchanged amount of the outer pipe depending on a supercooling degree value sensed by the supercooling degree sensing part.

3. The system according to claim 2, wherein the supercooling degree sensing part comprises a plurality of temperature sensors for sensing refrigerant temperatures of the high-pressure pipes disposed at inlet and outlet sides of the heat exchanging part.

4. The system according to claim 2, wherein the supercooling degree sensing part comprises:

a pressure sensor for sensing a refrigerant pressure of the high-pressure pipe disposed at an inlet side of the heat exchanging part; and a temperature sensor for sensing a refrigerant temperature of the high-pressure pipe disposed at an outlet side of the heat exchanging part.

5. The system according to claim 2, wherein the supercooling degree sensing part includes a temperature sensor and a pressure sensor for respectively sensing a refrigerant temperature and pressure of the high-pressure pipe disposed at an outlet side of the heat exchanging part.

6. The system according to claim 2, wherein the supercooling degree control unit comprises:

a bypass pipe branched from the high-pressure pipe disposed at an inlet side of the heat exchanging part and coupled to the outer pipe of the heat exchanging part;

an EEV (electronic expansion valve) installed in the bypass pipe, for controlling an amount of a refrigerant introduced into the outer pipe of the heat exchanging part through the bypass pipe; and a microcomputer for controlling an opening degree of the EEV so as to make a current supercooling degree equal to a predefined target supercooling degree, the current supercooling degree being sensed by the supercooling degree sensing part.

7. The system according to claim 6, wherein the microcomputer calculates a supercooling degree using a difference between a compensated temperature and a current temperature, the compensated temperature being provided by compensating for a prior-to-heat-change temperature sensed at the high-pressure pipe disposed at the inlet side of the heat exchanging part, the current temperature being sensed at the high-temperature pipe disposed at an outlet side of the heat exchanging part; and the microcomputer controls the opening degree of the EEV such that the calculated current supercooling degree is made to secure the predefined target supercooling degree.

8. The system according to claim 6, wherein the microcomputer calculates a supercooling degree using a difference between a saturation temperature, which corresponds to a pressure saturation position and is sensed from a refrigerant pressure of the high-pressure pipe disposed at an outlet side of the heat exchanging part, and a current temperature of the high-pressure pipe disposed at an outlet side of the heat exchanging part; and the microcomputer controls the opening degree of the EEV such that the calculated supercooling degree is made to secure the predefined target supercooling degree.

9. The system according to claim 1, wherein the refrigerant temperature control unit comprises:

a heat exchanging part including an inner pipe, whose both ends are coupled to the high-pressure pipe, and an outer pipe which a high-pressure refrigerant branched from the high-pressure pipe is introduced into and the introduced refrigerant is discharged to the low-pressure pipe, the outer pipe being extended to an outside of the inner pipe, such that high-pressure refrigerants are heat exchanged with each other;

a supercooling degree sensing part disposed at one side of the high-pressure pipe, for sensing temperature and pressure; and a supercooling degree control unit for controlling an amount of the branched high-pressure refrigerant introduced into the outer pipe so as to secure a supercooling degree of the high-pressure pipe according to the sensing result of the supercooling degree sensing part.

10. The system according to claim 9, wherein the supercooling degree control unit comprises:

a bypass pipe branched from the high-pressure pipe disposed at an inlet side of the heat exchanging part and coupled to the outer pipe of the heat exchanging part;

an EEV installed in the bypass pipe, for controlling an amount of a refrigerant introduced into the outer pipe of the heat exchanging part through the bypass pipe;

a microcomputer for controlling an opening degree of the EEV so as to make a supercooling degree equal to a predefined target supercooling degree, the supercooling degree being sensed by the supercooling degree sensing part;

a high-pressure inlet pipe coupled to the outer pipe of the heat exchanging part and the low-pressure pipe, for making a high-pressure refrigerant of the outer pipe flow through the low-pressure pipe; and a valve installed in the high-pressure inlet pipe, for preventing a refrigerant of the low-pressure pipe from being introduced into the outer pipe of the heat exchanging part.

11. The system according to claim 1, wherein the refrigerant temperature control unit comprises:

a heat exchanging part including an inner pipe whose both ends are coupled to the low-pressure pipe and an outer pipe whose both ends are coupled to the high-pressure pipe, the inner pipe being bent in a predetermined shape, the outer pipe being extended to an outside of the inner pipe, such that heat is exchanged due to a difference in temperature of a refrigerant flowing through the inner pipe and the outer pipe;

a superheating degree sensing part for sensing a supercooling of a refrigerant flowing through a low-pressure pipe disposed at inlet and outlet sides of the heat exchanging part; and a superheating degree control unit for calculating a superheating degree using the temperature and pressure sensed by the superheating degree sensing part and controlling an amount of the refrigerant flowing through the outer pipe such that the calculated superheating degree is made to follow a predefined target superheating degree.

12. The system according to claim 11, wherein the superheating degree control unit comprises:

a bypass pipe branched from the high-pressure pipe disposed at an inlet side of the heat exchanging part and coupled in parallel to the outer pipe of the heat exchanging part;

an EEV installed in the bypass pipe, for controlling an amount of a refrigerant introduced into the outer pipe of the heat exchanging part through the bypass pipe; and a microcomputer for controlling an opening degree of the EEV so as to make a current supercooling degree equal to a predefined target supercooling degree, the current supercooling degree being sensed by the supercooling degree sensing part.

13. The system according to claim 12, wherein the microcomputer calculates a superheating degree using a difference between a saturation temperature at a low-pressure, which is sensed from the low-pressure pipe disposed at an inlet side of the heat exchanging part, and a current discharge temperature of the low-pressure pipe disposed at an outlet side of the heat exchanging part; and the microcomputer controls the opening degree of the EEV such that the calculated superheating degree is made to secure the predefined target supercooling degree.

14. The system according to claim 1, wherein the refrigerant temperature control unit comprises:

a heat exchanging part including an inner pipe whose both ends are coupled to the high-pressure pipe and an outer pipe whose both ends are coupled to the low-pressure pipe, the outer pipe being extended to an outside of the inner pipe, such that heat is exchanged due to a difference in temperature of a refrigerant flowing inside the inner pipe and the outer pipe;

a supercooling/superheating degree sensing part disposed at an inlet side and/or an outlet side of a pipe of the heat exchanging part, for sensing pressure and temperature of a pipe; and a supercooling/superheating degree control unit for simultaneously controlling a supercooling of the high-pressure pipe and a superheating of the low-pressure pipe by controlling an amount of a refrigerant branched from the high-pressure pipe and introduced into the outer pipe of the heat exchanging part.

15. The system according to claim 14, wherein the supercooling/superheating degree control unit comprises:

a bypass pipe branched from the high-pressure pipe disposed at the inlet side of the heat exchanging part and coupled to the outer pipe of the heat exchanging part;

an EEV installed in a predetermined position of the bypass pipe; and a microcomputer for calculating a current supercooling/superheating degree based on the sensing result of the supercooling/superheating degree sensing part and controlling an opening degree of the EEV within a range in which the calculated supercooling/superheating degree satisfies the target supercooling/superheating degree.

16. The system according to claim 15, wherein the supercooling/superheating degree sensing part comprises:

a first temperature sensor and a first pressure sensor for respectively sensing temperature and pressure of the high-pressure pipe so as to sense a supercooling degree of the high-pressure pipe; and a second temperature sensor and a second pressure sensor for respectively sensing temperature and pressure of the low-pressure pipe so as to sense a superheating degree of the low-pressure pipe.

17. The system according to claim 15, wherein the supercooling/superheating degree sensing part includes one or more temperature sensors and/or one or more pressure sensors, which are disposed at one side of a pipe disposed at an inlet side and/or an outlet side of the heat exchanging part.

18. The system according to claim 1, wherein one or more refrigerant temperature control units are disposed at any one side among a position branched in a bridge shape in a plurality of indoor units, an inlet side of a single indoor unit, an inlet or outlet side of a distributor, and an inside of an indoor unit.

19. The system according to claim 1, wherein the refrigerant temperature control unit is installed with a single unit.

20. The system according to claim 1, wherein the refrigerant temperature control unit includes a supercooling degree control unit installed on an indoor unit side so as to secure a supercooling degree of the high-pressure pipe and/or a superheating degree control unit installed in an outdoor unit side so as to secure a superheating degree of the low-pressure pipe.

21. A method for controlling a temperature of a refrigerant, comprising:

performing a heat exchange due to a difference of a temperature between a high-pressure refrigerant and a low-pressure refrigerant using a heat exchanging part, the heat exchanging part including an inner pipe and an outer pipe whose both ends are coupled to high-pressure and low-pressure pipes connecting at least one indoor unit and at least one outdoor unit;

sensing at least one of a supercooling degree and a superheating degree at pipes disposed at one side of the heat exchanging part; and securing at least one of a supercooling degree and a superheating degree by increasing or decreasing a predetermined amount of a refrigerant flowing into the outer pipe of the heat exchanging part such that the at least one sensed supercooling degree or superheating degree is made equal to a target value.

22. The method according to claim 21, wherein a current supercooling degree is calculated using a temperature difference of a high-pressure pipe disposed at one side of the heat exchanging part, and a current superheating degree is calculated using a temperature difference of a low-pressure pipe disposed at one side f the heat exchanging part.

23. The method according to claim 21, wherein the heat exchange is performed by making a high-pressure refrigerant flow through the inner pipe and making a low-pressure refrigerant flow through the outer pipe, and the supercooling degree is secured by controlling an amount of a high-pressure refrigerant flowing into the outer pipe through a bypass pipe using an opening degree of an EEV so as to make the sensed supercooling degree equal to a target supercooling degree, the bypass pipe being branched from the high-pressure pipe.

24. The method according to claim 21, wherein the heat exchange is performed due to a difference in a refrigerant temperature by making a low-pressure refrigerant flow through the inner pipe and making a high-pressure refrigerant flow through the outer pipe, and the supercooling degree is secured by controlling an amount of a low-pressure refrigerant flowing into the outer pipe through a bypass pipe using an opening degree of an EEV so as to make the sensed supercooling degree equal to a target supercooling degree, the bypass pipe being branched from the high-pressure pipe.

* * * * *